US005443305A

United States Patent [19]

Heierli et al.

[11] Patent Number: 5,443,305

[45] Date of Patent: Aug. 22, 1995

[54] TUNNELLING MACHINE

[75] Inventors: Werner Heierli, Zurich; Kurt Baumann, Alpnach-Dorf, both of Switzerland

[73] Assignee: Heierli & Co., Zurich, Switzerland

[21] Appl. No.: 81,364

[22] PCT Filed: Oct. 21, 1992

[86] PCT No.: PCT/CH92/00214

§ 371 Date: Aug. 27, 1993

§ 102(e) Date: Aug. 27, 1993

[87] PCT Pub. No.: WO93/09333

PCT Pub. Date: May 13, 1993

[30] Foreign Application Priority Data

Oct. 30, 1991 [CH] Switzerland ..... 3182/91

[51] Int. Cl.[6] ..... E21D 9/08

[52] U.S. Cl. ..... 299/33; 299/58; 405/141

[58] Field of Search ..... 299/33, 56, 58, 90, 299/1-8; 405/138, 141, 144

[56] References Cited

U.S. PATENT DOCUMENTS 4,456,305 6/1984 Yoshikawa ..... 299/33

FOREIGN PATENT DOCUMENTS 0231404 8/1987 European Pat. Off. .
1203302 10/1965 Germany .
1534654 2/1969 Germany .
1966242 12/1971 Germany .
3003826 8/1981 Germany .
8511967 9/1986 Germany .
36808 6/1956 Poland ..... 299/33
1153454 5/1969 United Kingdom ..... 405/141

OTHER PUBLICATIONS

Tunnelbau, 1986 edition, pp. 319 to 362 and 1987 edition, pp. 103 to 139, published by the Deutsche Gesellschaft fur Erd-und Grunbau e.V.

*Primary Examiner*—David J. Bagnell
*Attorney, Agent, or Firm*—Tarolli, Sundheim & Covell

[57] ABSTRACT

A tunnelling machine for large cross-section tunnels (with a 12 m diameter and more), as well as for excavating loose rocks leading to groundwater, has a shield with a cylindrical case. A front section (1) of the case is rotary. The front face (3) of the rotary section is designed at least outside a central area (11) as a helical heading supporting surface at least approximately full when seen in the axial direction (6) of the tunnel. Preferably, the supporting surface is composed of several helical surfaces (4, 5) that supplement each other in the circumferential and/or radial directions. In the supporting surface is arranged at least one excavating shoulder (12, 13) whose surface is at an angle with respect to the supporting surface. An excavating device is preferably arranged on at least one excavating shoulder (12, 13). In the area of the supporting surface the earth or rocks are supported at the same time as they are excavated exclusively at the excavating shoulder(s).

29 Claims, 14 Drawing Sheets

TUNNELLING MACHINE

TECHNICAL FIELD

The present invention relates to a tunnel driving or digging machine with a shield having a cylindrical case.

With machines of this type the shield is driven into the ground (rock, loose stone), the ground being excavated protected by the shield case in the front area thereof, on the so-called tunnel or working face. The rear extension of the shield case, also known as a shield tail, overlaps the already made tunnel lining, so that its construction can continue corresponding to the advance protected by the shield case.

The main problem occurring with this type of tunnel driving, particularly in a material only having a limited internal cohesion (such as e.g. loose rock), is that at the working face not only is material excavated, but at the same time the working face, so as to prevent settlement or even collapse against which the earth pressure must be supported. If there is also ground water in the soil, then the working face must simultaneously be protected against the ground water pressure. This is particularly critical in those cases in which a tunnel is being driven at a very limited depth, which can be smaller than its diameter, through material having virtually no cohesion, with or without ground water and under built-over ground.

PRIOR ART

For supporting the working face and simultaneously holding back the ground water use has hitherto been mainly made of the compressed air method, the hydroshield advance method or the membrane shield method (cf. "Tunnelbau", 1986 edition, pp 319 to 362 and 1987 edition, pp 103 to 139, published by the Deutsche Gesellschaft für Erd- und Grundbau e.V., H. Eckard and P.M. Schnelzle: "Entwicklung des Membranschildverfahrens fur den hydraulischen Rohrvortrieb", TIS 19/88, pp 580–588).

In the compressed air method a working or excavation zone subject to the action of the compressed air is installed at the working face. The compressed air prevents the penetration of the ground water at the working face into said excavating zone. The compressed air method can only be used to a limited extent, i.e. only with certain building site conditions. For the support of the working face it is often necessary to have additional means, such as support plates pressed hydraulically against the working face. In the so-called bath system use is made of a drill head which simultaneously excavates and supports the working face. In the shield case only moving in the driving or advance direction the drill head performs a swinging rotary movement and is subdivided into movable, planar support plates and reversible, planar scraping plates covered with scraping blades or knives. Excavation takes place at the slots, which are obtained between the plates through the inclining thereof. It is generally disadvantageous in the compressed air method that working costs are high, work delays occur and there is a considerable risk of a collapse under heterogeneous building site conditions, whilst there is also a blow-out risk.

In the case of hydroshield driving the working face is supported by a supporting fluid, which is generally constituted by a bentonite suspension. The excavation zone is divided off upstream of the working face by a pressure wall from the rear shield and the already made tunnel, the excavation zone being subdivided by a breast wall into two communicating areas. The area upstream of the breast wall is completely filled with the supporting fluid, whereas the area behind it is only partly filled. Above the supporting fluid a plenum space, which is subject to pressure action is provided in the last-mentioned area. By regulating the air pressure, it is possible to regulate the pressure exerted by the supporting fluid on the working face. Excavation generally takes place by means of an opening cutting head in the supporting fluid. The excavated material is transported away with the supporting fluid by means of pump lines. The "consumed" bentonite leads to considerable costs. Due to the high cost of bentonite it is well worth separating it for reuse from the excavated material. The necessary separating equipment and the operation thereof are often as expensive as the actual tunnel driving machine and its operation. In addition, bentonite cannot be used with all ground or soil types.

The membrane shield method is a combination of the compressed air method and fluid support. A thin bentonite suspension membrane is applied by spraying to the working face within an excavating zone subject to compressed air action. The bentonite suspension has the property of closing the porous structure of the soil against the penetration of compressed air, so that the latter over the bentonite membrane brings about a flat support of the entire working face without escaping into the soil. However, the gaps which constantly form in the membrane during the material excavation at the working face must be constantly and immediately reclosed by the after-spraying of bentonite. Although bentonite consumption in this method is lower than with the previously described liquid or fluid support, the entire cross-section of the working face must be sealed with bentonite suspension and bentonite consumed during excavation must be continuously replaced. The method is also not usable under all soil or ground conditions, whilst the risk of blow-outs and collapses of cohesionless material persist.

DESCRIPTION OF THE INVENTION

The known, previously described tunnel driving machines or methods do not provide an adequate solution of the problem of the separation of the functions "support of the working face" and "excavation of the material at the working face". The problem of the invention is therefore to give a tunnel driving machine of the aforementioned type usable in all ground or soil types and particularly in the case of loose rock in ground water, in which there is a clearer separation between the "support of the working face" and "excavation of the material at the working face" functions and which can be operated without using a supporting fluid.

According to the invention this problem is solved. Thus, the tunnel driving machine according to the invention is mainly characterized in that the cylindrical shield case is subdivided into a front, rotary portion and a rear, non-rotary portion and that the front, rotary portion has a front face, which at least in a radial zone outside a central area is constructed as a helical surface-shaped curved supporting surface for the support of the working face and which is at least approximately in full-surface fore considered in the shield axis direction and that in said supporting surface there is at least one excavation gap, whose face is at an angle with respect to the supporting surface.

In said radial zone, the supporting surface can either be formed by a helical surface extending over a complete turn or convolution or, preferably, several helical surfaces optionally reciprocally displaced in the axial direction and supplementing one another in the radial and/or circumferential direction. In the latter case several excavation gaps are obtained in the helical surface.

The generatrixes of the at least one helical surface can be lines oriented in random manner to the shield axis, bent lines, stepped lines or curves. However, they are preferably lines oriented at right angles to the shield axis. If the supporting surface is formed from several helical surfaces, then they should have the same generatrix and a coinciding pitch.

There is preferably an excavation apparatus at the at least one excavation gap.

By means of the "helical shield" according to the invention, a perfect separation of the functions "support of the working face" and "material excavation at the working face" is brought about. During tunnel driving in said radial zone material excavation only takes place at the at least one excavation gap and substantially also only parallel to the helical surface-shaped supporting surface. In accordance with the advancing material excavation the front shield portion is rotated about its axis and simultaneously advanced. In the direction of the shield axis (axial direction/tunnel axis) there is a substantially full-surface, continuous, gap-free and direct contact between the supporting surface and the ground. As a result of its helical surface-shaped construction the supporting surface during tunnel driving is moved exactly parallel to the surface of the excavated ground along the working face. Compared with the overall area of the supporting surface the area of the at least one excavation gap can be very small (e.g. 6%), so that the supporting and sealing problems occurring there can be relatively easily controlled.

The tunnel digging machine according to the invention is particularly suitable for large tunnel diameters (up to 12 metres and more) for which there is an increasing need. It is also suitable or at least easily adaptable to virtually all ground or soil types, so that it is possible to drive a tunnel in the most varied soil layers (e.g. rock, loose stone with our without ground water, loam) without machine changes. The ground water problem can easily be controlled in that on the at least one excavation gap an excavating apparatus is provided, which completely covers and seals the same.

Further advantages can be gathered from the following description of embodiments with reference to the attached drawings.

PERFORMANCE OF THE INVENTION

Figure 1:
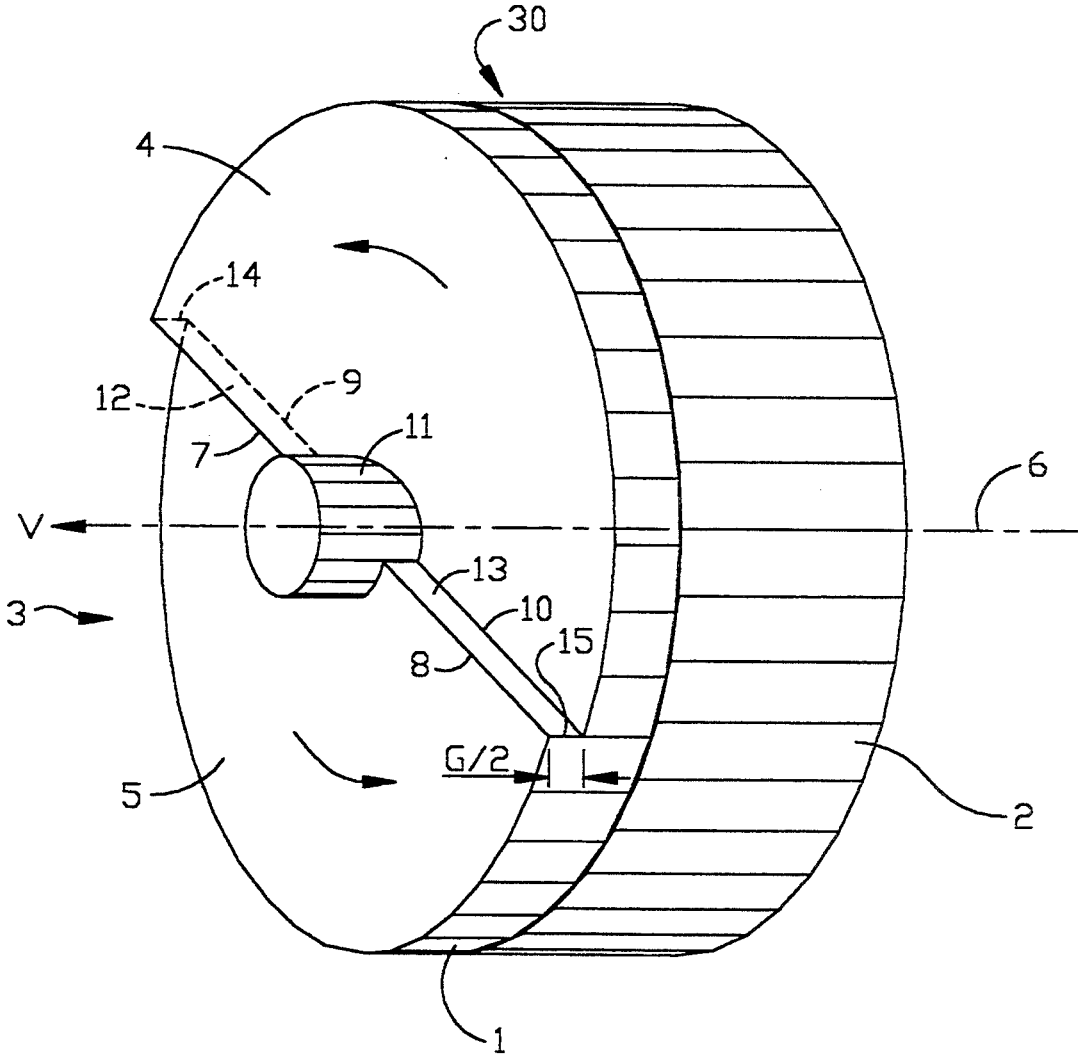
FIG. 1 A shield of a tunnel driving machine according to a first embodiment of the invention with a front and a rear shield portion in a view laterally from the front on the end face of the front shield portion construction as a supporting surface for the working face.
Figure 2:
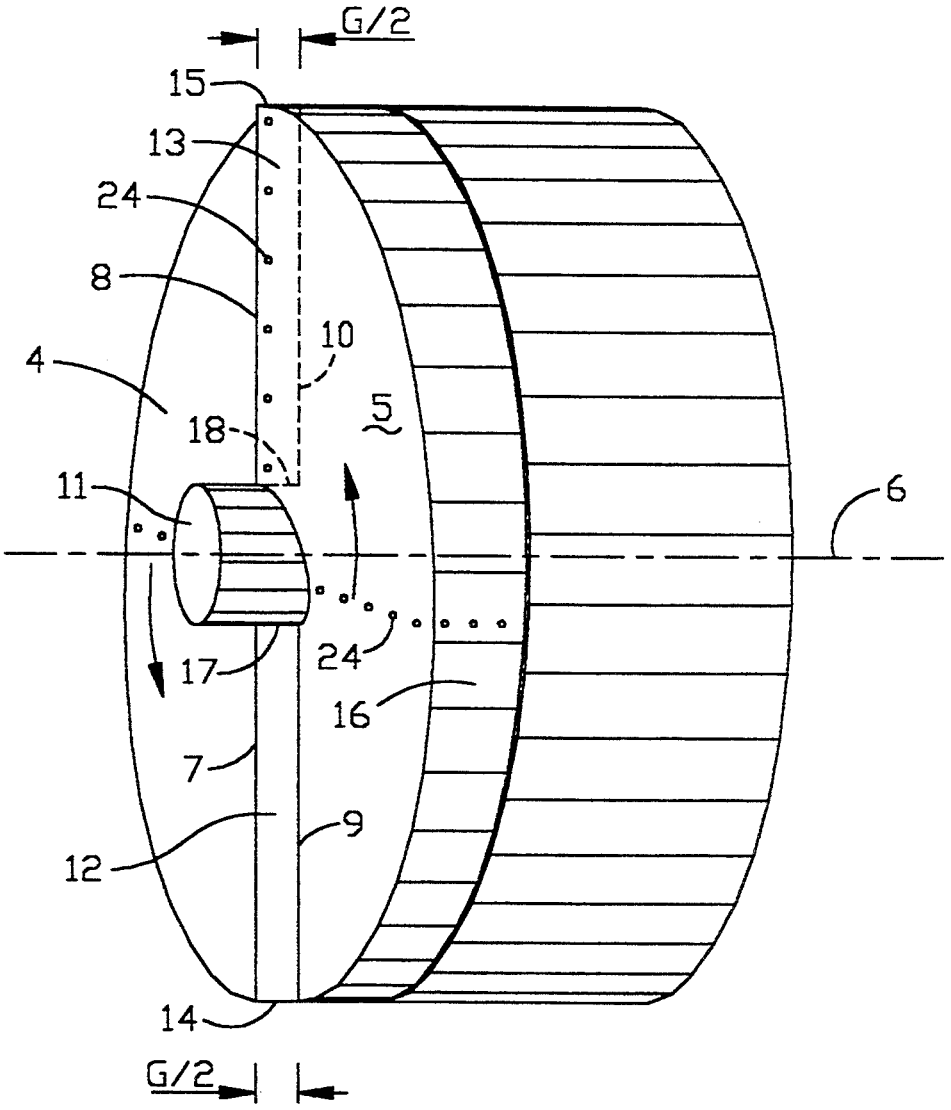
FIG. 2 The front portion of the same shield in a view laterally from the front.

FIGS. 1 and 2 show the shield of the tunnel driving machine, which is suitable for tunnel driving in non-stable soil with ground water.

The shield is subdivided into a front shield portion 1 and a rear shield portion 2. The front shield portion 1 is mounted in rotary manner on the rear shield portion 2, surrounds part of the outer shield case and has on its end or front face 3 a supporting surface for the working face firmly connected to said shield case part. The represented shield can have a diameter of e.g. 12 m or more.

The supporting surface for the working face on the front face 3 of the front shield portion 1 is in this embodiment formed by two helical surfaces 4 and 5, whose generatrix is in each case a line oriented at right angles to the shield axis 6. Each of the two helical surfaces 4 and 5 extends over half a turn and are reciprocally displaced by 180°, so that they together form a complete turn. In the axial direction they are arranged or displaced relative to one another in the present embodiment in such a way that their front edges 7 and 8, which are also referred to hereinafter as radial cutting edges, together with their rear edges 9 and 10, are in each case located in a common axial plane. The coinciding half pitch G/2 of the two helical faces 4, 5 is small compared with the diameter of the front shield portion 1 and is generally only roughly 1/10 of said diameter. However, it can be adapted according to the individual case to the soil mechanics characteristics of the ground.

In the centre of the described supporting surface and terminating same in the inwards direction is provided a hollow cylinder 11, which is subsequently referred to as the centre cylinder, which projects by a portion over the supporting surface in the tunnel driving direction, although this is not absolutely necessary.

Through being formed from the two helical surfaces 4 and 5 and as a result of their reciprocal axial displacement, in the radial zone between the centre cylinder 11 and the outer shield case surface 16 two gaps 12, 13 are formed in the supporting surfaces. As a result of the choice of the generatrix of the helical surfaces as lines oriented at right angles to the shield axis 6, said two gaps are rectangular here and surface-oriented perpendicular to the helical surfaces 4, 5. The gaps are bounded by the aforementioned front and rear, radially directed edges 7 to 10 of the helical surfaces 4, 5, as well as by axially directed edges 14, 15 on the circumferential surface 16 of the front shield portion 1, as well as 17, 18 on the centre cylinder 11. Hereinafter the edges 14, 15 are also referred to as axial cutting edges. The edges 7, 9, as well as 8, 10 are parallel to one another, so that the width of the gaps 12 and 13 is constant over their entire radial extension.

Figure 3:
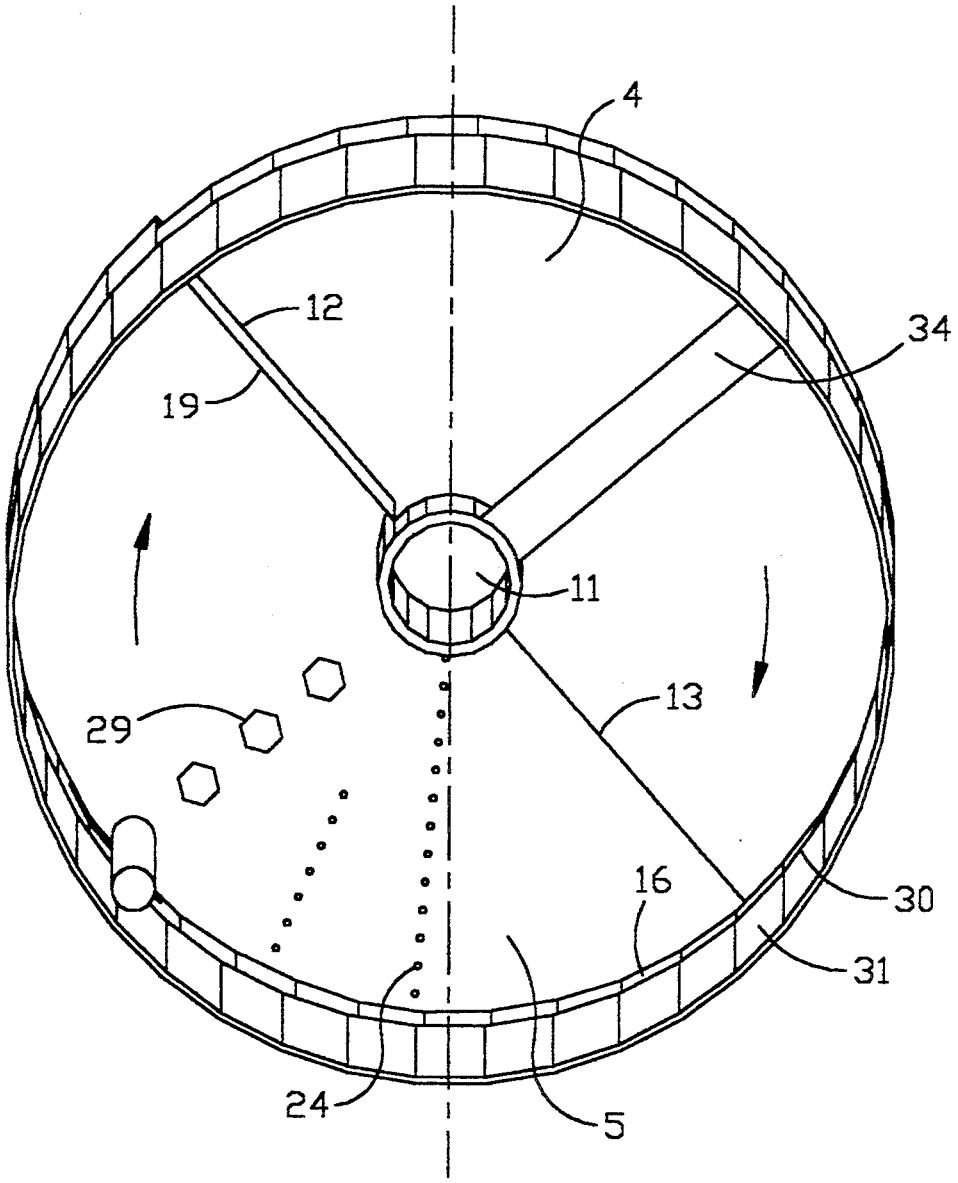
FIG. 3 A view from the rear into the interior of the shield and on the back of the end face of the front shield portion constructed as a supporting surface.

The gaps 12, 13, hereinafter also called radial excavation gaps, are, in operation, tightly closed in each case by a radial excavation apparatus acting on their gap face as a radial excavation face. In FIG. 3, which is a view of the front shield portion from the rear, i.e. from the tunnel side, only one radial excavation apparatus is shown by the reference numeral 19 at the excavation gap 12. In the centre cylinder 11 there is also a not shown, central excavation apparatus acting on its cross-sectional face as the central excavation face and which also completely closes the latter. As all the openings in the end face 3 of the front shield portion 1 are completely sealed by the aforementioned excavation apparatuses, ground water and soil are prevented from escaping.

The excavation of soil necessary for driving the tunnel only takes place at the gaps 12, 13 and within the centre cylinder 11. Corresponding to the advancing material excavation, the front shield portion 1 is rotated about its axis 6 in the direction of the arrows in FIG. 1 and the entire shield structure is further advanced in the advance or driving direction V in accordance with the pitch of the helical surfaces 4, 5. The end face 3 of the front shield portion 1 is always slightly pressed against the working face in the tunnel (until the so-called, subsequently explained static pressure is reached). This can e.g. take place in that the rear shield portion 2 is continuously supported in an appropriate manner, e.g. by means of hydraulic advance pressing, on the already formed tunnel lining (normally so-called tubbings) or on the lateral faces of the already formed tunnel chamber. It is a characteristic of the construction according to the invention that each point on the helical surfaces slides on a spiral in the ground, without pressing into the ground or moving away from the latter. Between the ground and the helical surfaces in principle no gap is formed.

Figure 4:
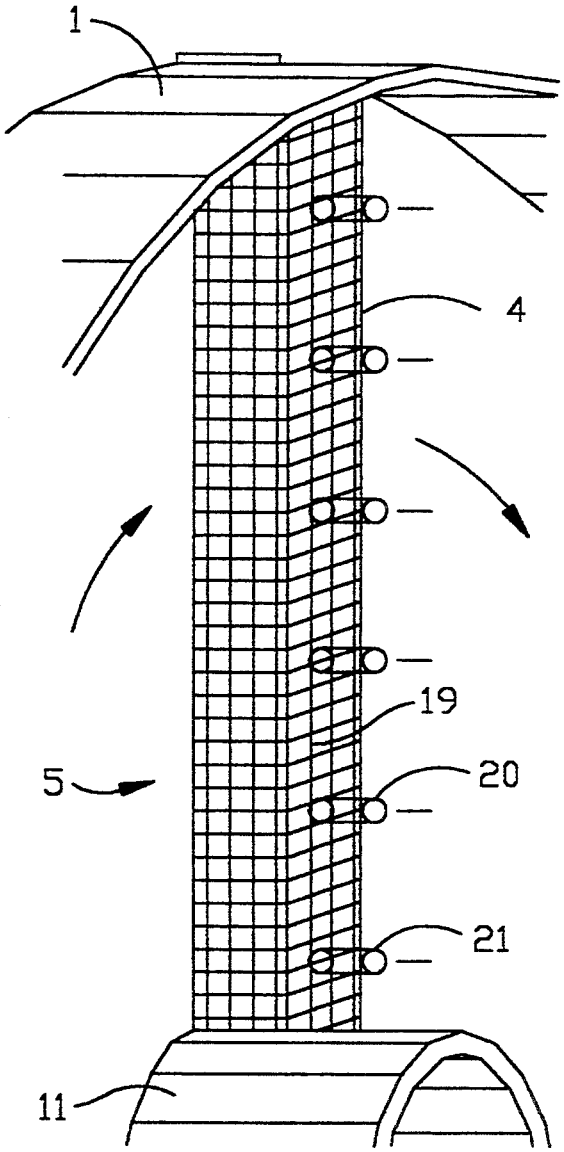
FIG. 4 A detail enlargement of an excavating apparatus installed on the back of the supporting surface.

As with the excavation apparatus 19 in the represented embodiment, the radial excavation apparatuses can be constructed as an excavation case only open towards the excavation face, detachably fitted at the back on the supporting surface and closed at the rear. Said excavation case is provided with connections 20, 21 for feeding in water and for pumping out the water-/excavation material mixture (FIG. 4). Undesired settlement in the soil can be reliably avoided in that per unit of time only that amount of water-excavation material mixture is removed or pumped out of the excavation cases as water is introduced into the same during the same time and excavation material is excavated at the excavation front in accordance with the advance and rotary speed of the front shield portion 1. Therefore the excavation case always remains full of water and material. By means of a not shown compressed air buffer the water pressure in the excavation case can be regulated and in particular adapted to the local ground water pressure. Particularly in the case of larger tunnel diameters the excavation case 19, as shown in FIG. 4, is preferably radially subdivided into several chambers, so as to be able to take account of the height-dependent or otherwise differing pressure of the ground water between the tunnel roof and floor. The pressure in each chamber is then separately controlled and the pressure naturally progressively varies with the rotation position of the front shield portion 1.

It is possible to provide in the excavation case 19 active excavation equipment, such as drill hammers, adapted to the soil mechanics characteristics. The excavation equipment can preferably be exchanged for similar or, if made necessary by the soil mechanics requirements, also different excavation equipment. However, it is also possible to dismantle the excavation apparatus as a whole and replace it by a different excavation apparatus.

Figure 5:
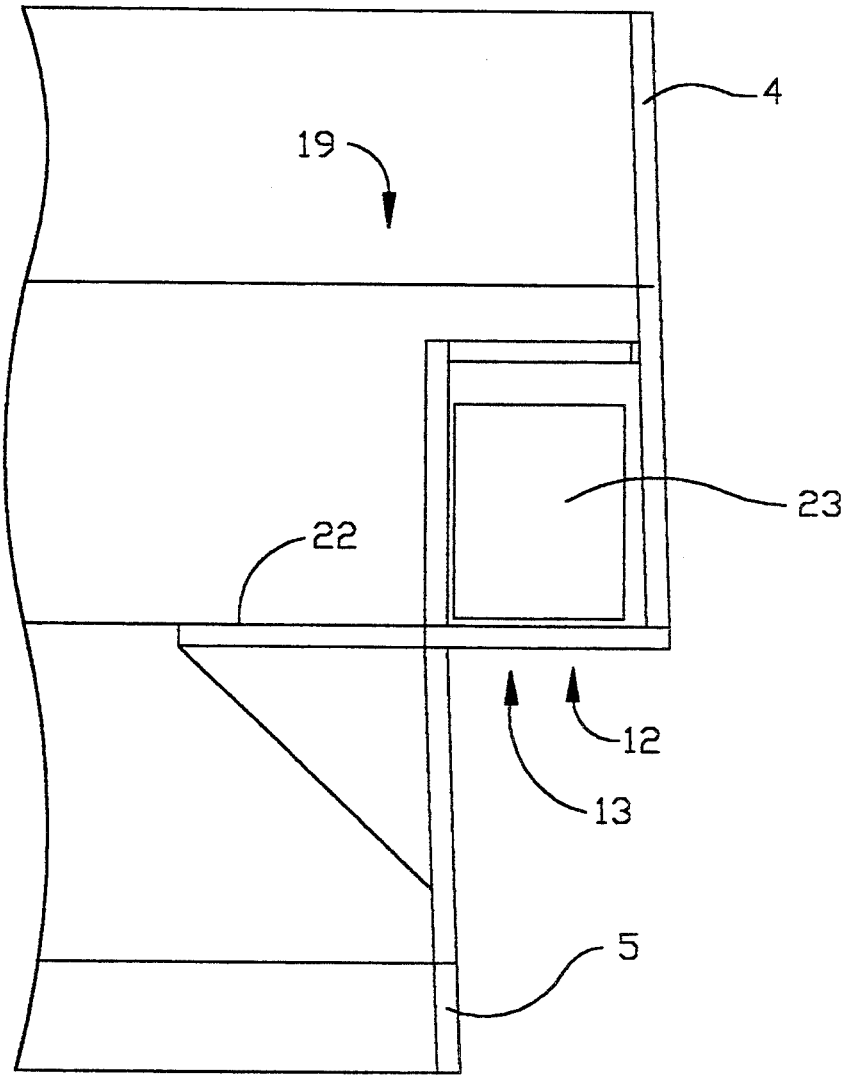
FIG. 5 A cross-section through the excavating apparatus and through a slide mechanism associated therewith for closing the excavation gap below the excavation apparatus.

In order to avoid local and temporary breaks in the support of the working face, as well as in the ground water sealing during a tool change or a replacement of the complete excavation apparatus, in the manner shown in FIG. 5 it must be possible to close the excavation gaps 12, 13 by a slide mechanism 22. In order that the slide can be advanced, any excavation equipment in the excavation case and which are not shown in FIG. 5 and are represented by reference numeral 23, must be retracted somewhat from the excavation front in the excavation gap. For safety reasons it is advantageous if a complete excavation apparatus is to be replaced, to rotate the front shield portion until the excavation face is located horizontally and in downwardly directed manner below the excavation apparatus to be replaced, so that no soil bears on the excavation case. Naturally it is also advantageously possible to provide a slide mechanism on the central excavation face in the centre cylinder 11.

Instead of by means of slide mechanisms, as a function of the soil type, soil and ground water penetration can be prevented with compressed air, as in the known compressed air method. The risk of settlements or collapses is significantly lower than in the conventional compressed air method, because the surface area of the radial excavation gaps is only a few percent of the working face area. It is also advantageous to rotate the front shield portion until the excavation gaps are horizontal, because in this case the ground water pressure level over the surface of the excavation gaps is constant.

During the excavation process known procedures can be used as a basis. Possible excavation procedures are hewing, hewing with a nozzle (water jet), cutting, drilling, chipping, roll chipping, pile driving cutting tools, pressing in cutting tools or the aforementioned membrane shield method. Due to the relatively small surface of the excavation gaps 12, 13, the support problem is less critical than in the case of the aforementioned known methods. The disadvantages mentioned e.g. in conjunction with the membrane shield method scarcely occur.

The aforementioned cutting edges 7, 8, as well as 14, 15 on the radial excavation gaps 12, 13 can e.g. be covered with a dense row of rock drill hammers, which drill free the path for the cutting edges. There is no need for an advance for the drills, because this is provided by the rotation of the front shield portion 1, together with the necessary contact pressure.

With regards to the working direction the excavation equipment used in the excavation case should mainly be oriented in the helical direction of the two helical surfaces 4, 5, i.e. tangentially thereto. As the curvature of the helical surfaces increases towards the axis thereof, said direction is dependent on the radial spacing of the installation location of the individual excavation equipments. Therefore excavation equipments installed with a limited centre distance, i.e. nearer to the centre cylinder, must be more axially oriented than those with a larger centre distance.

It is also advantageous to position the excavation equipment located along the radial and axial cutting edges 7, 8 and 14, 15 on the radial excavation gaps 12, 13, with respect to their working direction, in such a way that there is a slight overcutting or notching of said edges. As a result of the overcutting the frictional force on the supporting surface can be considerably reduced on rotation. However, overcutting must be kept within limits, so that there is no excessive settlement.

If the excavation equipment provided for the overcutting can be controllable individually or at least groupwise with respect to their action and/or working direction, then by a differently controlled overcutting, particularly of the outer axial cutting edges 14, 15 on the shield case, the tunnel digging machine can be controlled and corrected with respect to its driving direction.

The aforementioned excavation methods are also suitable for excavation in the centre cylinder 11. The conditions are as for the driving of tunnels with relatively small diameters. The diameter of the centre cylinder 11 should be as small as possible. The smaller the diameter, the steeper the pitch of the helical surfaces 4, 5 with respect to the centre cylinder in the case of small radii. This can make excavation at the radial excavation gaps more difficult. A centre cylinder diameter of approximately 1/6 of the shield diameter would appear to be suitable for many applications. For certain applications there may be no need for the centre cylinder.

The transporting away of material from the excavation apparatuses best takes place by means of pumping out in pipes. Optionally the material must be sufficiently comminuted in the excavation apparatuses by using stone crushers, so that it can be pumped away with water in the pipes. If there is no ground water transporting away without water is also possible.

Figure 6:
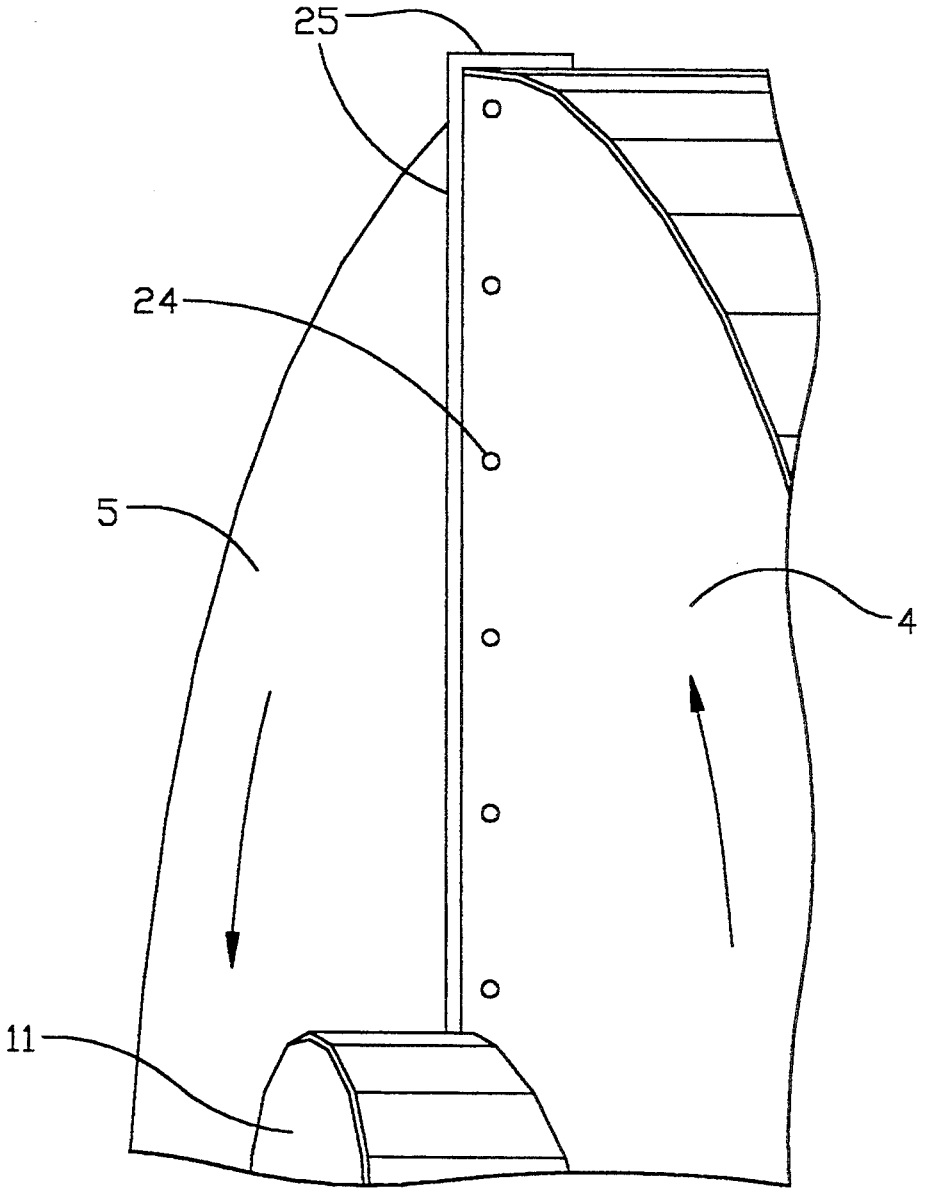
FIG. 6 A larger-scale detail of the front shield portion, once again in a view laterally from the front.

On rotating the front shield portion 1 the friction occurring between it and the ground must be overcome. The overcutting on the radial excavation gaps 12, 13 has already been mentioned as a measure for reducing this friction. For reducing friction it is also possible to press a lubricant (e.g. bentonite and/or air bubbles) between the ground and the supporting surface, as well as between the ground and the outer circumferential surface of the front shield portion 1, so that a lubricating film with or without air bubbles is obtained there. This function is fulfilled by the rows of lubricating nozzles or air nozzles on the aforementioned surfaces designated 24 in FIGS. 2 and 6. A row of nozzles/air nozzles is positioned in the rotation direction behind the cutting edges 7, 8 or 14, 15 of the radial excavation gaps. Further rows of nozzles/air nozzles are arranged at a right angle thereto on the supporting surface, respectively in the axial direction on the shield case surface 16. For the protection of the lubricating nozzles/air nozzles 24 can be used overcutting plates along the cutting edges 7, 8 or 14, 15 of the radial excavation gaps 12, 13, which are positioned upstream of the lubricating nozzles in the rotation direction. FIG. 6 clearly shows these overcutting plates 25.

As the overcutting plates 25 are subject to increased wear, they must be easy to replace from the rear, i.e. from the tunnel side. If a controlled overcutting is desired, they must also be adjustable together with the excavation equipment used for overcutting in such a way that the amount of overcutting over the radial or axial cutting edges can be continuously adjusted from zero to a clearly defined, maximum amount as a function of the rotation position.

It is possible to constructionally integrate the overcutting plates 25 into the excavation apparatuses 19 and to fit same in a manner such that they can be displaced or rotated as a whole. The overcutting plates 25 could also form an independent overcutting apparatus together with the excavation equipment provided for overcutting.

Figure 7:
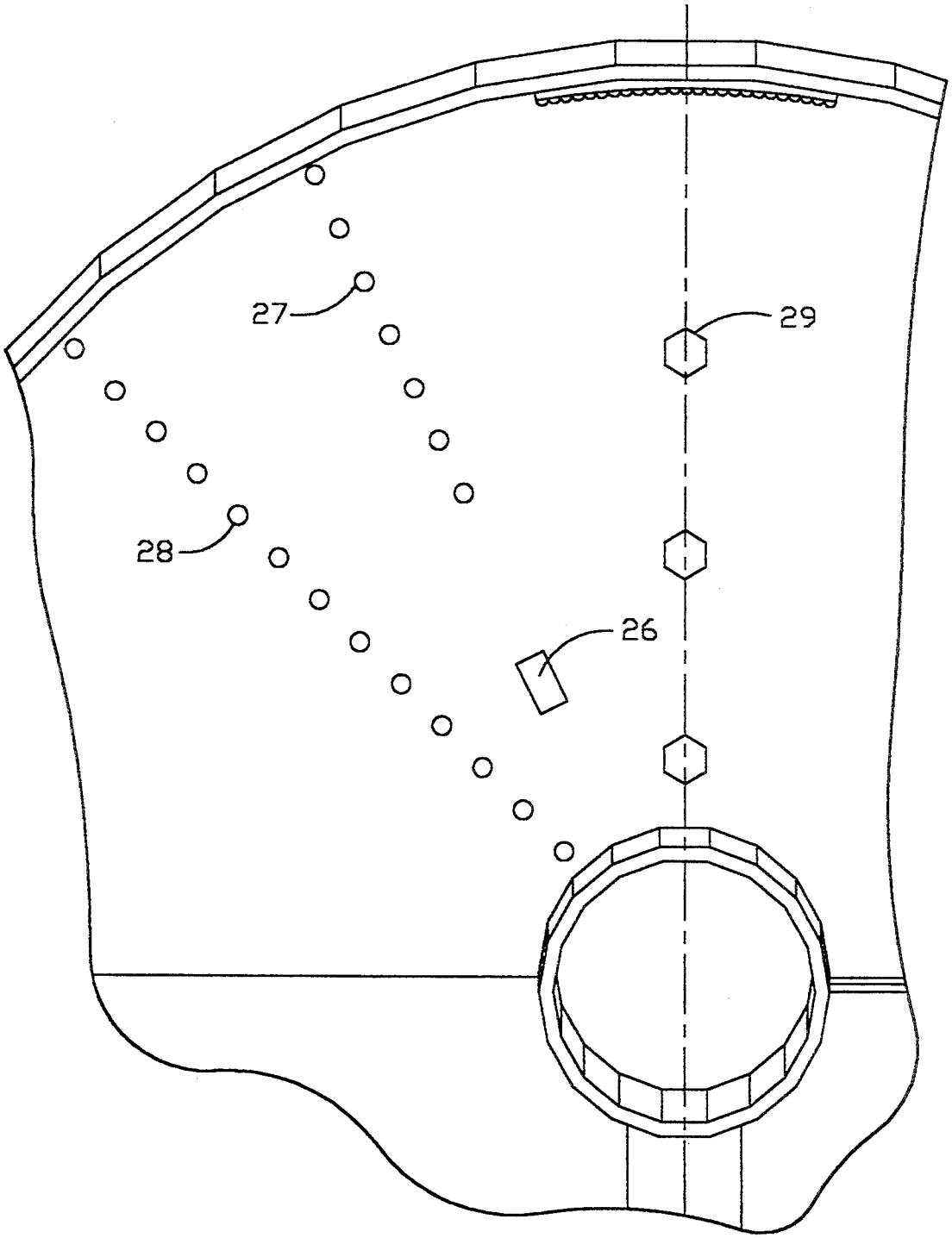
FIG. 7 A larger-scale detail of the back of the supporting surface with different devices provided thereon.
Figure 8:
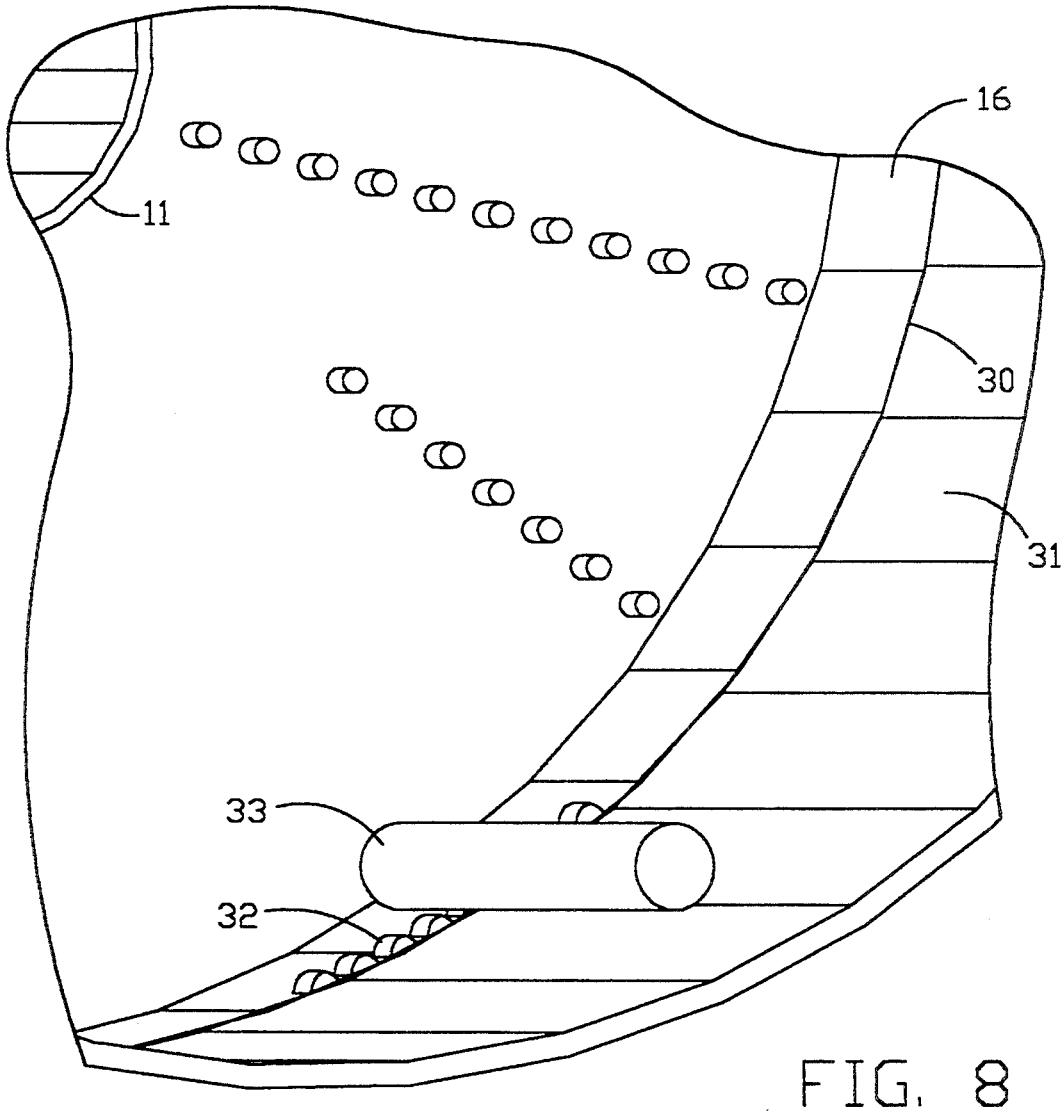
FIG. 8 A detail enlargement of the drive mechanism for the front, rotary shield portion.

The surface not covered by the excavation apparatuses 19 on the back of the supporting surface can be used with advantage for the fitting of further installation elements. Thus, e.g. for further reducing friction, vibrators can be fixed to the back of the supporting surface and as a result it is given small amplitude vibrations. Such a vibrator is shown at 26 in FIG. 7. In addition, it is possible to fit sensors, particularly radar sensors at said location and with the aid of these it is e.g. possible to detect in good time blocks in the ground upstream of the supporting surface and, if necessary, they can be comminuted beforehand. Such a radar sensor is designated 27 in FIG. 7. For the passage of tools for the prior comminution of larger blocks or for mechanical sounding, stuffing boxes 28 are provided. Finally, the supporting surface contains hatches or locks 29 which can be opened for taking soil samples. Such locks are necessary for soil carrying ground water or with unstable soil.

The front shield portion 1 is mounted in a manner resistant to tension and pressure on the rear shield portion 2 by means of low-friction bearings (not shown) distributed over the shield case. This bearing support can also be constructed in such a way that there is a slight articulation action utilizable for the direction control of the tunnel driving machine, i.e. so that the axis of the front shield portion 1 can be rotated by a small angle relative to the axial direction of the rear shield portion. The gap between these two shield portions is sealed by means of a seal 30. For the rotary driving of the front shield portion are provided hydraulic drive motors 33 fixed to the inside of the shield case 31 of the rear shield portion 2. For the force or power transfer from the drive motors 33 to the front shield portion 1 a rack/pinion 32 is provided on the latter.

The rotary mounting and the force transfer on the outer shield case lead to reduced stresses compared with a centrally positioned shaft. In addition, the area in the centre of the tunnel remains free for other installations, such as e.g. suction pipelines. It would also be possible to have a central drive mechanism.

Figure 9:
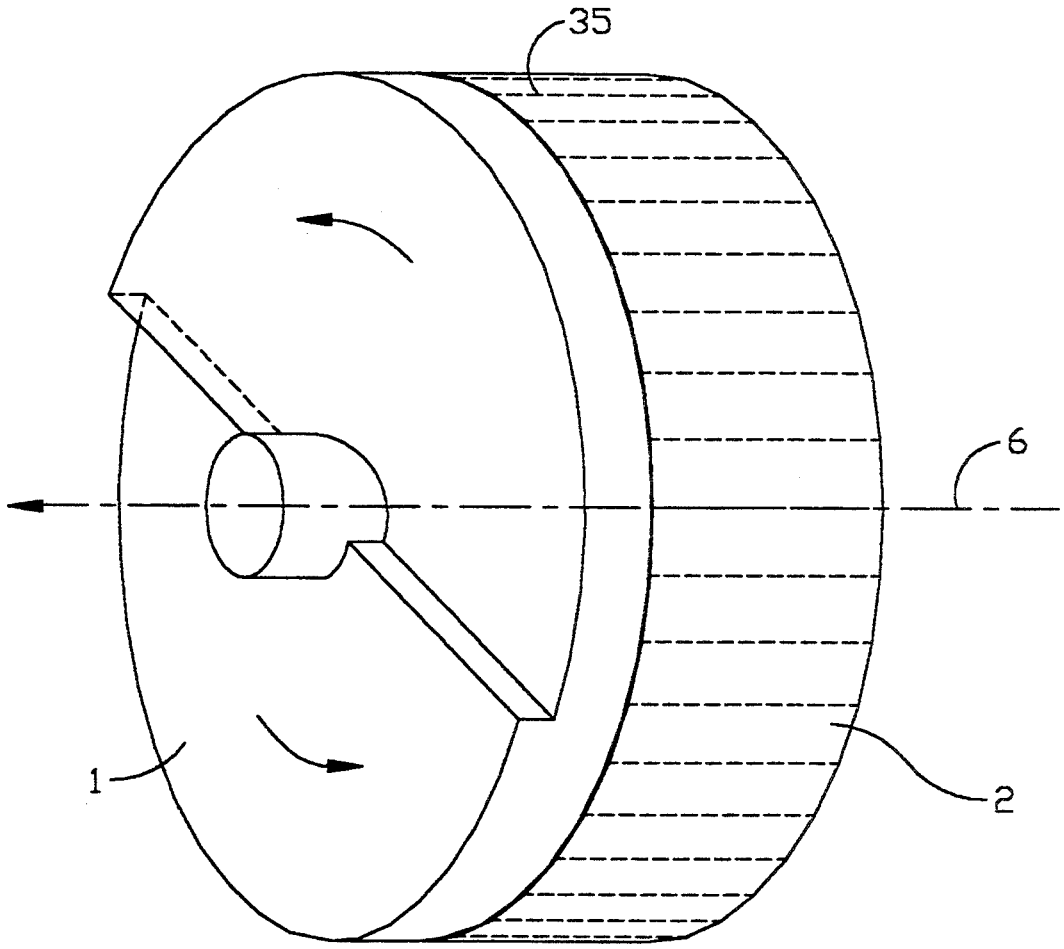
FIG. 9 A view corresponding to FIG. 1 of a shield, in which the shield case of the rear shield portion is externally provided with ribs.

To make it easier for the rear shield portion 2 to absorb the torque of the front shield portion 1 and divert same into the ground, on the case of the rear shield portion can be externally provided axially directed and circumferentially distributed longitudinal ribs 35, which engage in the soil. Such longitudinal ribs are shown in FIG. 9. The longitudinal ribs 35 can be firmly welded. However, they are preferably height-adjustable from the inside, i.e. from the tunnel side and are preferably also interchangeably fitted from the inside.

In order that the shield structure according to the invention can reliably absorb the forces acting on it during tunnel driving, it must be sufficiently stiff. Only one of the stiffened portions provided for this purpose in the front shield portion is shown at 34 in FIG. 3.

The forces acting on the shield are the superimposing pressure, the lateral pressures, the bearing pressure from below acting on the shield circumferential surface, the pressure from the front against the supporting surface, the frictional forces and the driving forces. The magnitude of the forces is dependent on the local circumstances under ground, i.e. the soil type, the superimposing height and the ground water level. The greatest shield case stressing occurs if the superimposing pressure and the side pressure are at different levels. This occurs if there is an extra-outbreak at the sidewalls and the shield is not adequately laterally supported. Similar stresses occur if the lateral pressure is very high and there is an extra-outbreak on the roof and in the floor area. The forces acting on the shield case are in principle the same as with conventional tunnel driving machines.

Figure 10:
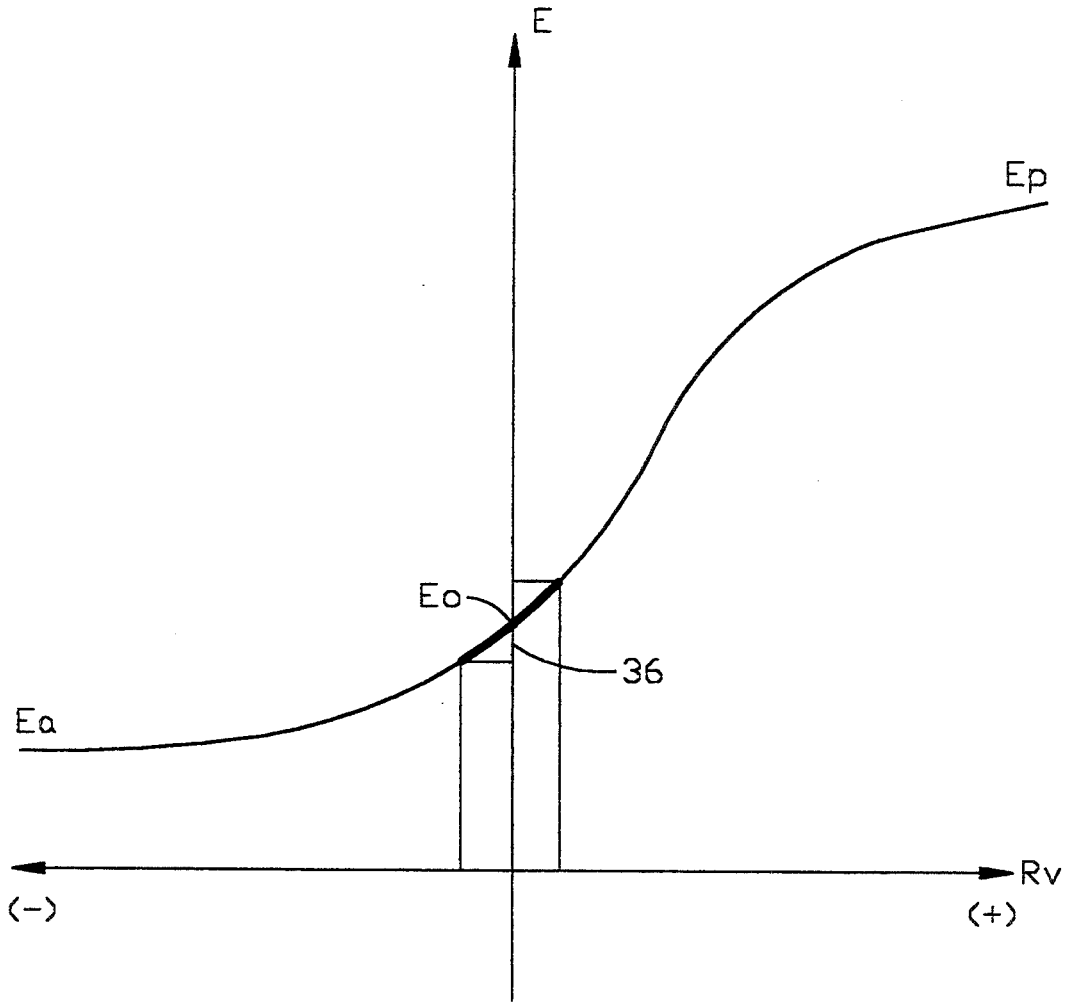
FIG. 10 A diagram more particularly showing the soil pressure acting on the end face of the front shield portion as a function of the relative displacement of the tunnel driving machine with respect to the soil.

The magnitude of the frictional forces on and parallel to the end face 3 is inter alia determined by the magnitude of the normal forces acting on the end face due to the soil pressure and the hydrostatic pressure (perpendicular to the end face). Through a suitable control of the advance and the excavation speed of the machine it is possible to influence the normal forces. If the advance is greater than the excavation capacity, a so-called passive soil pressure $E_p$ builds up and in the reverse case a so-called active soil pressure $E_a$ builds up. The passive soil pressure $E_p$ produces forces which can virtually not be overcome, whereas with an active soil pressure $E_a$ there is a settlement risk. The machine is preferably controlled in such a way that a pressure in the static pressure range is obtained. In the diagram of FIG. 10, where the soil pressure E is shown as a function of the relative displacement $R_v$ of the tunnel digging machine with respect to the soil, the static pressure is designated $E_O$ and the working area 36 of the tunnel digging machine according to the invention around the static pressure is designated 36. In the case of said machine the soil pressure acting on the shield is usually lower than in conventional machines (e.g. with the aforementioned bath shield), because with the tunnel driving machine according to the invention no excavation takes place in the axial direction (apart from any possible excavation in the centre cylinder) and instead it only takes place at the excavation gaps perpendicular thereto.

For overcoming static friction on starting up the rotary movement, the front shield portion 1 can in jerky manner be placed under a rotary movement, in that e.g. a radially moving (rotating) mass is decelerated.

Figure 11:
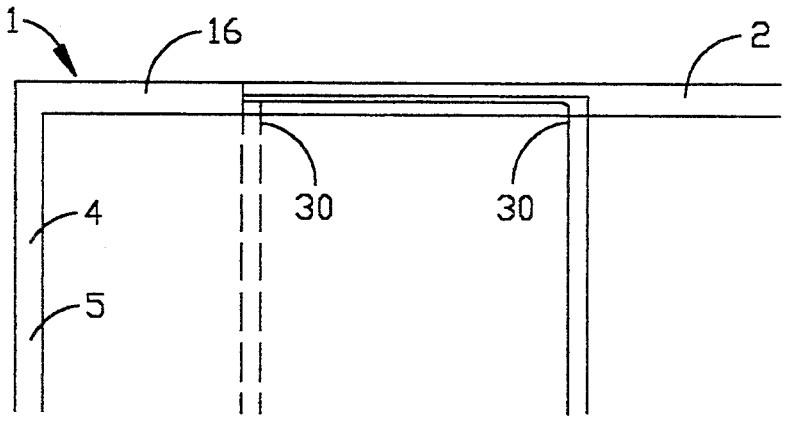
FIG. 11 A sectional representation of the overlap area between the shield case of the front and the rear shield portion.

The frictional forces acting on the circumferential surface of the front, rotating shield portion 1 can be constructionally reduced in that the extension of said shield portion is axially reduced. However, in order to still obtain an adequately stable mounting of the front shield portion on the rear shield portion 2, the shield case of the front shield portion can have a partial diameter reduction and can be inserted in the shield case of the rear shield portion and made to overlap therewith, as shown in FIG. 11. The seal 30 is to be correspondingly constructed.

As has already been stated, the tunnel driving machine according to the invention can be controlled with respect to its advance direction by different overcutting along the cutting edges 7, 8 and 14, 15 on the radial excavation gaps 12, 13, by means of the articulated mounting of the front shield portion 1 on the rear shield portion 2, as well as by differentiated pressure build-up (considered in the tunnel cross-section). Horizontal and vertical curves can be covered.

The tunnel driving machine according to the invention, without use restrictions, can be employed in the most varied loose materials and also, when a suitable excavation apparatus 19 is used, in solid rock. It is consequently unnecessary to change to a different tunnel driving machine on penetrating solid rock portions. For excavation in rock or other solid material without ground water it is not absolutely necessary for the excavation apparatuses to be closed. The excavation gaps can be open or partly open. Under special soil conditions there may even be no need for excavation apparatuses with active excavation equipment. In this case excavation of the soil would take place solely by cutting with the aforementioned cutting edges. If the tunnel driving machine according to the invention is to be exclusively or mainly used for rock or solid material without ground water, then the excavation gaps can be given a relatively large surface form. It can be advantageous here to have more than two excavation gaps by having more than two reciprocally supplementing partial turns of fitting helical surfaces. The supporting surface could also be formed solely by a complete turn or convolution of a single helical surface. This results from what has been described if the reciprocal axial displacement of the two helical surfaces 4, 5 is removed.

Figure 12:
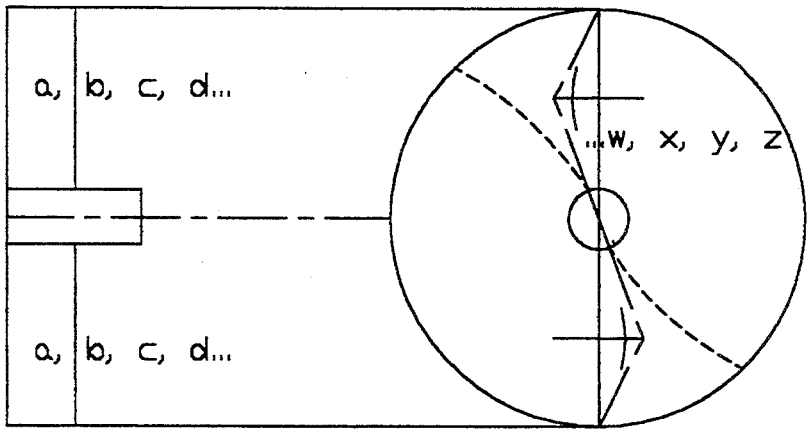
FIG. 12 Diagrammatically possible variants for the choice of the generatrix for the supporting surface.
Figure 13:
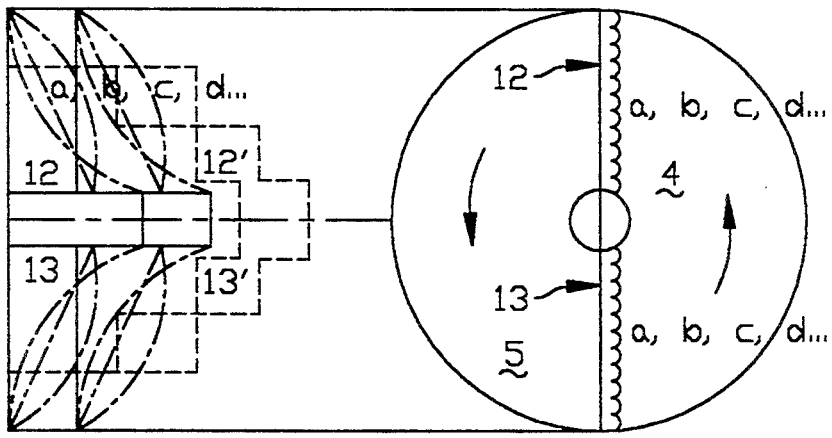
FIG. 13 Diagrammatically further variants for generatrix choice.

The generatrixes of the helical surfaces need not necessarily be straight. In FIGS. 12 and 13 small letters a to z show examples of helical surfaces, whose generatrix are oblique-angled lines with respect to the axial direction, axially curved curves or radially bent or stepped lines or curves. The variants shown can also be combined.

The at least one excavation gap in the supporting surface need not necessarily be oriented perpendicular thereto. However, even if it is not arranged at a right angle, the excavation direction substantially parallel to the supporting surface remains unaffected.

Overcutting plates can be provided on the centre cylinder, as on the cutting edges of the radial excavation faces.

Figure 14:
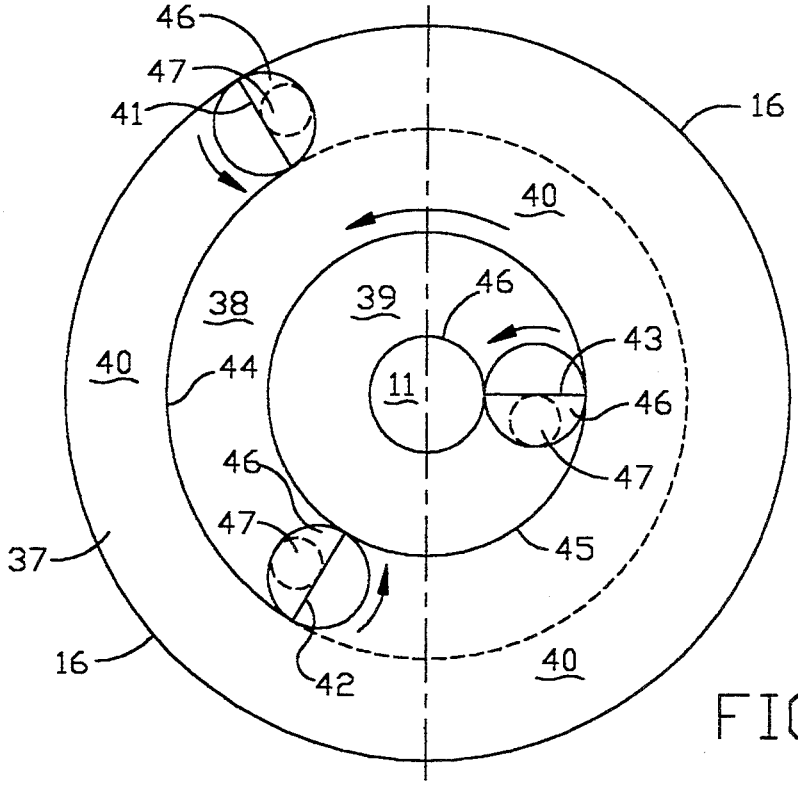
FIG. 14 A plan view from the front of the supporting surface of the front portion of a shield according to another embodiment of the invention.
Figure 15:
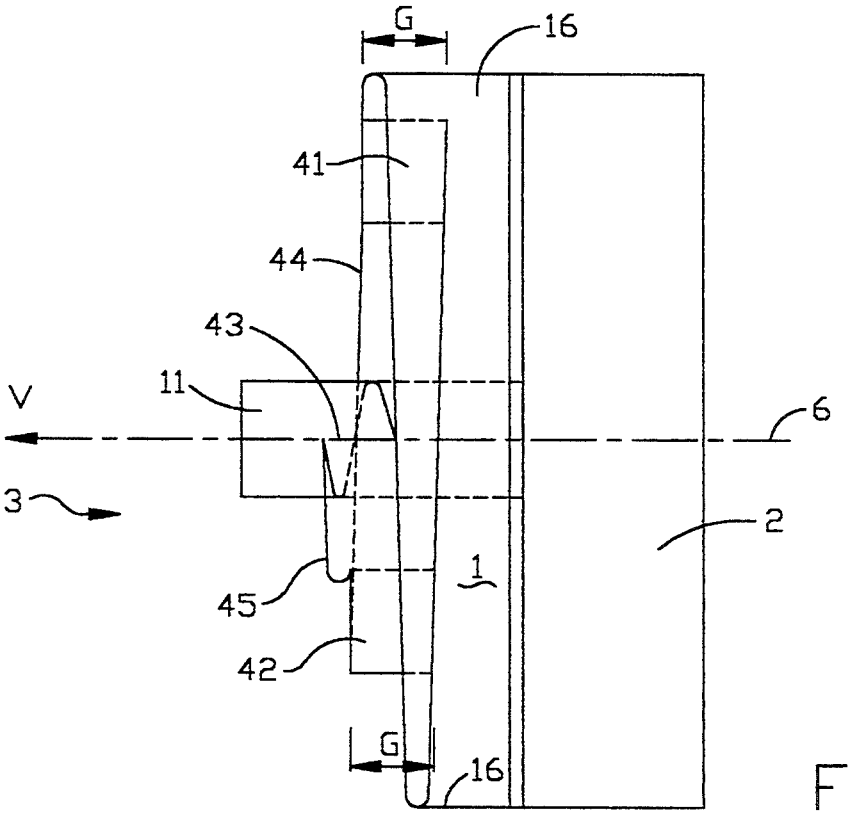
FIG. 15 The shield portion of FIG. 14 in side view.

FIGS. 14 and 15 show an embodiment of the tunnel driving machine according to the invention, in which the supporting surface for the working face is formed by radially supplementing helical surfaces and not by circumferentially supplementing helical surfaces, as in the previously described embodiment. In this case there are three circular ring-shaped helical surfaces 37, 38, 39 extending over the complete circumference, but only over part of the radial zone between the centre cylinder 11 and the outer shield case 16 and which are concentric to one another. However, a different number of concentric helical surfaces could also be provided. The supporting surface 3 has three excavation gaps 41, 42, 43, which are reciprocally displaced by 120° in each case. The individual helical surfaces 37, 38, 39 are so axially arranged relative to one another (although not prescribed), that they merge to form a unitary helical surface 40. Only along the excavation gaps, as well as the edges 44 and 45, is there an axial displacement by the pitch G in the helical surface 40. The axial displacement along the edges 44, 45 is closed by a cylindrical surface. Such cylindrical surfaces must also optionally be provided along the dashed boundary lines in FIG. 14 between the concentric helical surfaces 37, 38 and/or 39, if they are to be axially mutually displaced unlike in the selected embodiment.

At the excavation gaps 41, 42, 43 in this embodiment there are once again excavation apparatuses 46, which are here provided with actively rotating excavation cylinders. The rotation axes of these cylinders are parallel to the shield axis 6. Preferably the excavation apparatuses 46 seal the excavation gaps, so that the tunnel driving machine can be used for soil carrying ground water.

The excavation cylinders excavate material on the side facing the ground as a result of their rotary movement and supply it on the side remote from the ground to a pipe 47, in which it is removed with water.

The excavation cylinders could also rotate about a not shown axis oriented perpendicular to the excavation surfaces. However, only part of the substantially rectangular excavation surface would be covered by the excavation cylinders. This arrangement is consequently only suitable in a material, in which the not directly attacked surfaces of the excavation gaps automatically break down during excavation.

In the invention the first described embodiment, in which the supporting surface is formed by circumferentially supplementing helical surfaces could be combined with the further embodiment in which the helical surfaces are radially supplemented. It would also be possible to use excavation apparatuses with rotating excavation cylinders in the first mentioned embodiment and conversely excavation and/or overcutting apparatuses of the type described in conjunction therewith in the further embodiment.

Figure 16A:
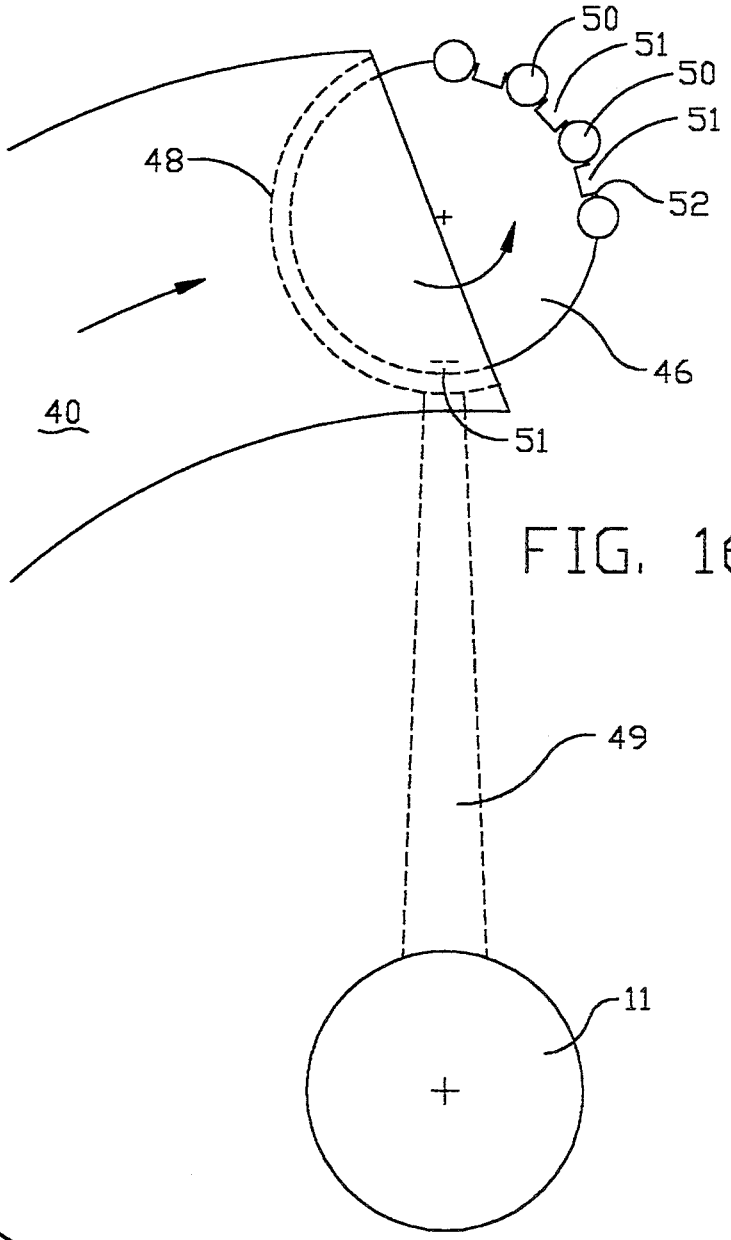
FIG. 16A A preferred development of the shield portion according to FIG. 14 with a rotary excavation apparatus provided with excavation buckets and roller bits.

A further development of the tunnel driving machine according to FIG. 14 is shown in FIG. 16A. Only one of the three circular ring-shaped helical surfaces which together form the helical surface 40 are shown. The excavation apparatus 46 is once again constructed as an excavation cylinder or wheel. Each excavation wheel is installed on corresponding circular rings and is so designed that it can excavate all materials, including rock. For this purpose the excavation wheel is provided on its circumferential surface with a plurality of distributed roller bits 50, only those located in a quadrant being shown in FIG. 16A. The roller bits 50 also loosen solid excavation material. They project from the excavation apparatus 46 to such an extent that they make the way free for the shield part located behind the excavation apparatus 46. This shield part is also compartmentalized by an inner formwork 48 against the excavation apparatus 46.

Figure 16B:
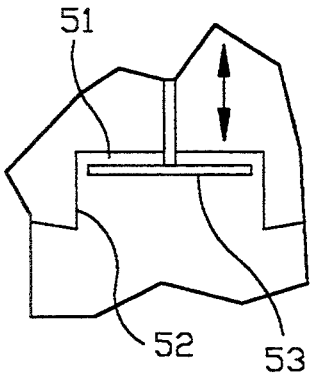
FIG. 16B A detail enlargement of an excavation bucket according to FIG. 16A with an integrated ejector.

Between the roller bits 50 are provided excavation buckets 51 (shown diagrammatically in FIG. 16A), which are provided on the rear side in the rotation direction with a broaching device, e.g. a projecting broaching plate 52 (FIG. 16B). By means of the broaching devices the excavated material is filled into the excavation buckets 51. As shown in detail in FIG. 16B, each of the excavation buckets 51 is equipped with a displaceable bottom portion 53, which on filling the bucket is constantly pressed inwards by the excavation material. The buckets 51 are emptied by means of an ejecting channel 49, which runs between the excavation apparatus 46 and the central area or the centre cylinder or centre pipe 11 below the helical surface 40.

As soon as one of the filled excavation buckets 51 during the rotation of the excavation apparatus 46 faces the ejection channel 49, the bottom portion 53 is pressed downwards by a suitable means, e.g. a hydraulic cylinder and ensures that the entire excavation material in the ejection channel 49 migrates towards the centre pipe 11, even if the ejection channel happens to be upwardly directed. The ejection channel 49 is slightly conically widened towards the centre, so that there is not excessive wall friction or bridge formation.

The parts fitted on the excavation wheel and in particular the roller bits are wearing parts and must be consequently replaceable. This can take place e.g. in succession from the rear by means of a closable opening in the inner formwork 48. If the excavation wheel is left in direct, supporting contact with the soil at the excavation front, the tool change can also be reliably carried out in non-stable soils without any collapse risk. If necessary, for sealing against ground water prior to the opening of the inner formwork the gaps between the excavation wheel and the shield or inner formwork 48 can be sealed with injected plastic foam or the like. So as to be able to get into the interior of the excavation wheel and optionally replace parts there, it would also be possible to provide a lateral opening in the inner formwork or the possibility of circumferentially opening the said wheel. The drive of the excavation wheel takes place relative to the front shield part 1. The rotation direction of the excavation wheels is preferably chosen in such a way that it is opposite to the rotation direction of the complete shield. This advantageously leads to a reduction of the necessary torque for the complete shield. The energy for the rotation of the front shield portion and the excavation wheels must be obtained from the rear, non-rotary shield portion and transferred to the rotary parts. As a result of the slow rotary movement of the shield, this can take place by means of hang-round electrical or hydraulic lines. Alternatively the energy can be "tapped" on the circumference by pinions, which are fixed to the front shield portion and on the fixed, rear portion run on a rack.

Figure 17:
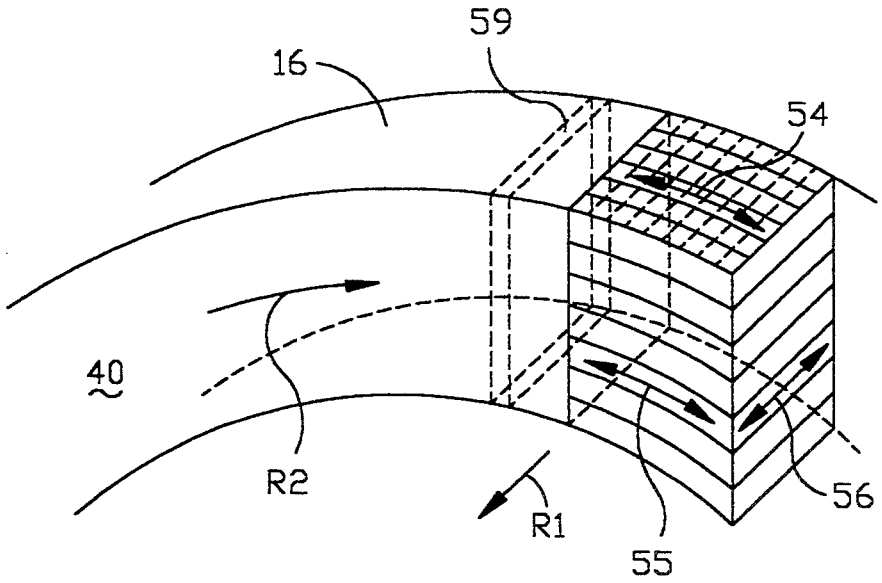
FIG. 17 An embodiment of the invention with drivable pile walls arranged around the excavation gap for restricting a material volume to be excavated.
Figure 18:
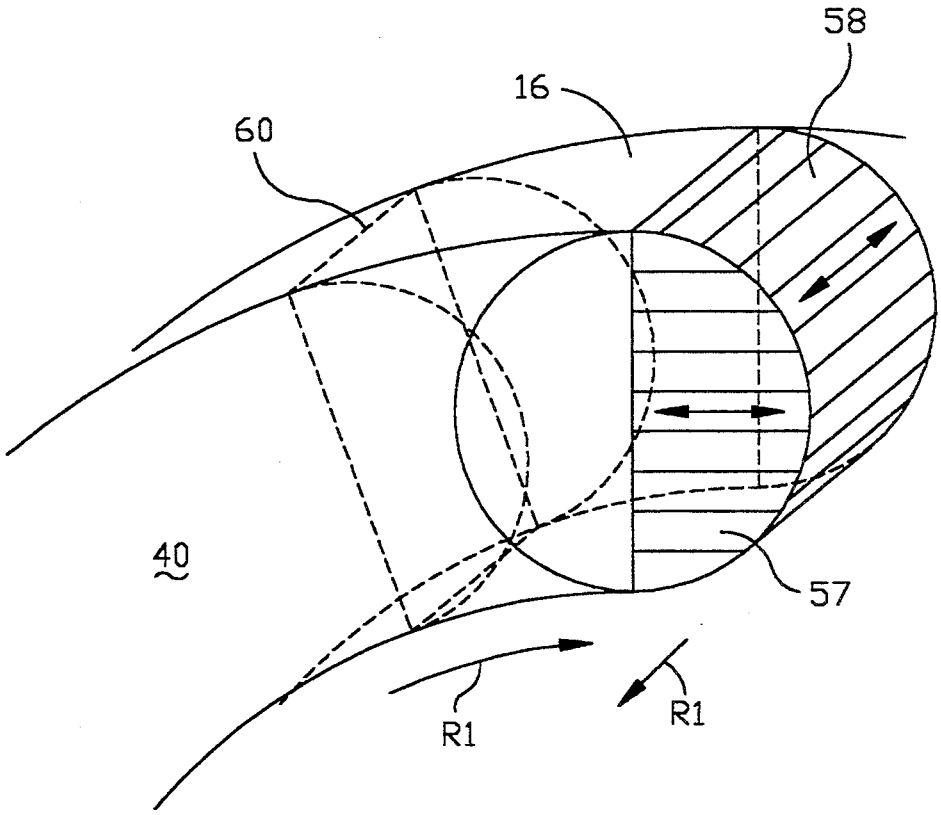
FIG. 18 Another embodiment of the invention, once again with drivable pile walls, but which have a different shape.

A further preferred embodiment of the tunnel driving machine according to the invention usable in non-stable, water-carrying soil is diagrammatically shown in FIGS. 17 and 18. In this case on each of the circular rings shown in FIG. 14 is provided an excavation apparatus, which works with a plurality of pile walls 54 to 58 displaceable relative to the front shield portion and shown in hatched form in FIGS. 17 and 18. In this case there is a stepwise excavation or driving. With the front shield portion stationary, from the latter, e.g. through suitable slots, during each working cycle the pile walls 54 to 58 are so driven into the ground that a few cubic metres of excavation material is defined. In the variant of FIG. 17 two pile walls 54, 55 are driven in the rotation direction R2 of the front shield part and one pile wall 56 in the shield advance direction R1 until they are adjacent to one another and enclose a virtually parallelepipedic volume. As is also indicated in broken line form in FIG. 17, the pile wall 54 could also be driven in the shield advance direction R1. In the variant according to FIG. 18 a pipe wall 57 driven in rotation direction R2 cooperates with an approximately semicircular bent pipe wall 58 driven in the shield advance direction R1. After driving the pile walls and defining an excavation volume, the latter can be cleared out without any risk of collapse or significant water or fine material losses from the tunnel zone and using a suitable closeable opening. If necessary, in the vicinity of the abutting edges of the pipe walls an improved seal against penetrating water can be brought about by injecting plastic foam or the like.

The pile walls 54 to 58 are constructed in the manner of sheet pile bulkheads and preferably comprise longitudinally interconnected piles, which are mutually longitudinally displaceable and which can therefore be individually and successively driven into the ground. For the pile walls and at least for the front cutting edges of the individual piles, it is possible to use a high-strength material with a greater thickness and appropriate shape, so that they can optionally even be driven into solid, but not very hard rock or into larger blocks incorporated into otherwise softer material. The piles can even have a type of bit action. It could also be advantageous to provide water nozzles or the like on the front cutting edges of the piles.

Following the complete removal of the volume defined by the pile walls, the front shield portion is subsequently rotated. In order that this is possible, beforehand at least the front pile walls (in the embodiment according to FIG. 17 the pile wall 56 and in the embodiment according to FIG. 18 the pile wall 58) must be retracted again. The lateral pile walls 54, 55 (FIG. 17) or 57 (FIG. 18) can be left fixed, because the shield can move away over them.

So that there are no collapse phenomena during the retraction of the front pile walls, preferably beforehand a support element or body is introduced into the hollow volume. A support element can in particular be used in the embodiment according to FIG. 17 in the form of a support wall. In FIG. 17 a support wall is shown in broken line form at 59 and is hydraulically advanced in the shield rotation direction R2 up to the front pile wall 56 and then together with the left fixed lateral pile walls 54, 55, after retracting the front pile wall 56, supports and secures the removed volume.

A support body can in particular be used in the embodiment according to FIG. 18. The latter indicates in broken line form at 60 a roughly half-barrel-shaped support body. The latter can be rigid and hydraulically movable, but can also be constructed in the form of a compressed air or water-filled bag or bellows. When using a closed support body, apart from the front pile wall, without any risk of collapse the lateral pile walls could be retracted again prior to the subsequent rotation of the front shield portion.

Pressure-stable, reusable foams are known, which could be used for filling the cavity prior to the retraction of the pile walls. It would also be conceivable in a soft material, to advance the lateral pile walls 54, 55 (FIG. 17) or 57 (FIG. 18) simultaneously with the subsequent rotation of the front shield portion.

It is also conceivable in the apparatus according to FIG. 16A to use a pile wall like the wall 58 of FIG. 18, in order to compartmentalize the excavation wheel from the working face, so that it can be repaired in undisturbed form or completely replaced.

A combination of the two concepts of continuous excavation wheel or stepwise pile wall driving could be recommended when driving in soil having varying characteristics. Thus, continuous driving with the excavation wheel could be used e.g. in stable soil, as well as solid rock, whereas pile wall driving would only be used if the material was resilient and there was a risk of collapse.

We claim:

1. A tunnelling machine including:

a shield having a cylindrical case, said cylindrical case being subdivided into a front rotary portion and a rear non-rotary portion, said front rotary portion having a face which at least in a radial zone outside a central area includes a helical shaped supporting surface and a work face area, said supporting surface being curved to extend about a shield axis, said work face area extending at an angle relative to said supporting surface and being located at an excavation gap of said supporting surface defined by an axial discontinuity in said supporting surface; and an excavation apparatus is provided in said work face area at said excavation gap, said excavation apparatus extending across said excavation gap and sealing said excavation gap.

2. A tunnelling machine as set forth in claim 1, wherein said excavation apparatus includes an excavation case, said excavation case opens toward said excavation gap and is attached to a part of said front rotary portion behind said supporting surface, said excavation case includes connections for introducing water and for pumping out water and excavated material.

3. A tunnelling machine as set forth in claim 2, wherein said excavation case is radially subdivided into a plurality of chambers, said excavation apparatus including means for separately regulating a water pressure within each of said chambers in response to local ground water pressure and rotational position of said front rotary portion.

4. A tunnelling machine as set forth in claim 1, wherein said excavation apparatus includes excavation equipment which has an action direction, said excavation equipment is oriented relative to said supporting surface such that the action direction of said excavation equipment is substantially aligned with a direction of movement of said supporting surface.

5. A tunnelling machine as set forth in claim 4, wherein said excavation equipment includes one or more of hammer drills for chipping, tools for hewing, tools for hewing with a water jet, tools for cutting, tools for drilling, tools for milling, tools for pressing, tools for pile driving, tools for membrane method excavation and rotary excavation cylinders.

6. A tunnelling machine as set forth in claim 1, wherein said excavation apparatus includes excavation equipment which has an action direction, said excavation apparatus including means for orienting said excavation equipment for rotation related controlled overcutting at a front edge of said support surface.

7. A tunnelling machine as set forth in claim 1, wherein said excavation gap is externally defined at a circumferential extent of said front rotary portion by an axially extending shield case edge, said case edge being a cutting edge, said excavation apparatus including excavation equipment which has an action direction, said excavation equipment including means for orienting said excavation equipment for controlled over-cutting at said case edge.

8. A tunnelling machine as set forth in claim 1, wherein said excavation apparatus being removable and replaceable as a unit, a slide mechanism being provided for tightly sealing said excavation gap when said excavation apparatus is removed.

9. A tunnelling machine as set forth in claim 1, wherein said excavation apparatus includes an excavation cylinder rotating in a direction counter a rotation of said front rotary portion, said excavation cylinder having a plurality of excavation buckets located at a circumferential extent of said excavation cylinder for receiving excavated material upon rotation of said excavation cylinder, an ejection channel extends within said shield behind said supporting surface, said excavation buckets are emptied into said ejection channel, said ejection channel being for transporting the excavation material from said excavation cylinder toward the central area.

10. A tunnelling machine as set forth in claim 9, wherein said excavation cylinder includes a broaching device associated with each of said excavation buckets for forcing the excavated material from said excavation buckets.

11. A tunnelling machine as set forth in claim 10, wherein said excavation cylinder includes roller bits located between said excavation buckets on said circumferential extent of said excavation cylinder.

12. A tunnelling machine as set forth in claim 9, wherein said ejection channel being conical in shape and increasing in size toward said central area.

13. A tunnelling machine as set forth in claim 9, wherein each of said excavation buckets having a radially displaceable bottom portion for ejecting the excavated material.

14. A tunnelling machine as set forth in claim 9, including an inner framework for sealing between said front rotary portion and the excavation apparatus and means for opening said inner framework for permitting access to said excavation apparatus.

15. A tunnelling machine including:

a shield having a cylindrical case, said cylindrical case being subdivided into a front rotary portion and a rear non-rotary portion, said front rotary portion having a face which at least in a radial zone outside a central area includes a helical shaped supporting surface and a work face area, said supporting surface being curved to extend about a shield axis, said work face area extending at an angle relative to said supporting surface and being located at an excavation gap of said supporting surface defined by an axial discontinuity in said supporting surface; and vibrators for vibrating said front rotary portion, said vibrators being fixed to a segment of said front rotary portion behind said supporting surface.

16. A tunnelling machine including:

a shield having a cylindrical case, said cylindrical case being subdivided into a front rotary portion and a rear non-rotary portion, said front rotary portion having a face which at least in a radial zone outside of a central area includes a helical-shaped supporting surface and a work face area, said supporting surface being curved to extend about a shield axis, said work face area extending at an angle relative to said supporting surface and being located at an excavation gap of said supporting surface defined by an axial discontinuity in said supporting surface; and said supporting surface including a plurality of stuffing boxes for permitting the passage of an article from within said shield to a location outside of said shield, said article being either a tool or a probe.

17. A tunnelling machine including:

a shield having a cylindrical case, said cylindrical case being subdivided into a front rotary portion and a rear non-rotary portion, said front rotary portion having a face which at least in a radial zone outside of a central area includes a helical-shaped supporting surface and a work face area, said supporting surface being curved to extend about a shield axis, said work face area extending at an angle relative to said supporting surface and being located at an excavation gap of said supporting surface defined by an axial discontinuity in said supporting surface; and a plurality of lubricating nozzles located on said supporting surface for pressing a lubricant between the ground and said supporting surface and between the ground and said shield.

18. A tunnelling machine including:

a shield having a cylindrical case, said cylindrical case being subdivided into a front rotary portion and a rear non-rotary portion, said front rotary portion having a face which at least in a radial zone outside of a central area includes a helical-shaped supporting surface and a work face area, said supporting surface being curved to extend about a shield axis, said work face area extending at an angle relative to said supporting surface and being located at an excavation gap of said supporting surface defined by an axial discontinuity in said support surface, said excavation gap being externally bounded on a circumferential surface of said front rotary portion by an axially extending case edge which acts as an axial cutting edge;

an over-cutting plate;

means for movably mounting said over-cutting plate for outward advancement from said case edge and for removal of said over-cutting plate from said front rotary portion; and a plurality of lubricating nozzles for pressing a lubricant between the ground and said support surface and between the ground and said shield.

19. A tunnelling machine including:

a shield having a cylindrical case, said cylindrical case being subdivided into a front rotary portion and a rear non-rotary portion, said front rotary portion having a face which at least in a radial zone outside of a central area includes a helical-shaped supporting surface and a work face area, said supporting surface being curved to extend along a shield axis, said work face area extending at an angle relative to said supporting surface and being located at an excavation gap of said supporting surface defined by an axial discontinuity in said supporting surface; and a plurality of sensors for detecting inhomogeneities in the soil upstream of said supporting surface, said sensors being mounted on said rotary front portion behind said supporting surface, said sensors including probes or a radar device.

20. A tunnelling machine including:

a shield having a cylindrical case, said cylindrical case being subdivided into a front rotary portion and a rear non-rotary portion, said front rotary portion having a face which at least in a radial zone outside a central area includes a helical-shaped supporting surface and a work face area, said supporting surface being curved to extend along a shield axis, said work face area extending at an angle relative to said supporting surface and being located at an excavation gap of said support surface defined by an axial discontinuity in said supporting surface; and a plurality of hatches through said supporting surface for permitting access to the soil upstream of said supporting surface.

21. A tunnelling machine including:

a shield having a cylindrical case, said cylindrical case being subdivided into a front rotary portion and a rear non-rotary portion, said front rotary portion having a face which at least in a radial zone outside a central area includes a helical-shaped supporting surface and a work face area, said supporting surface being curved to extend about a shield axis, said work face area extending at an angle relative to said supporting surface and being located at an excavation gap of said supporting surface defined by an axial discontinuity in said supporting surface; and means for sealing a separating gap between said front rotary portion and said rear non-rotary portion.

22. A tunnelling machine as set forth in claim 21, including means for mounting said front rotary portion on said rear non-rotary portion, said means for mounting includes means for providing tension between said front rotary portion and said rear non-rotary portion, means for resisting pressure and means for permitting slight movement of said front rotary portion relative to said rear non-rotary portion.

23. A tunnelling machine as set forth in claim 22, including a hydraulic drive motor internally fixed to said rear non-rotary portion and which is in engagement with a gear rim on said front rotary portion.

24. A tunnelling machine as set forth in claim 21, wherein said rear non-rotary portion includes a plurality of circumferentially distributed and longitudinally extending ribs.

25. A tunnelling machine as set forth in claim 24, including means for varying the radial height of said ribs from the tunnel side, said ribs being removable from said rear non-rotary portion for replacement.

26. A tunnelling machine including:

a shield having a cylindrical case, said cylindrical case being subdivided into a front rotary portion and a rear non-rotary portion, said front rotary portion having a face which at least in a radial zone outside a central area includes a helical-shaped supporting surface and a work face area, said supporting surface being curved to extend along a shield axis, said work face area extending at an angle relative to said supporting surface and being located at an excavation gap of said supporting surface defined by an axial discontinuity in said supporting surface; and a plurality of pile walls located at said excavation gap, said pile walls being displaceable axially relative to said front rotary portion and being displaceable in the rotation direction of said front rotary portion for advancement into the soil upstream of said helical surface to define a closed volume within which excavation material is located.

27. A tunnelling machine as set forth in claim 26, wherein said pile walls are planar.

28. A tunnelling machine as set forth in claim 26, wherein said pile walls are generally semi-circular.

29. A tunnelling machine as set forth in claim 26, including a support element located in the volume defined by said pile walls for preventing the collapse of the material in the volume during retraction of said pile walls upon emptying of the volume.

* * * * *